US008895217B2

(12) United States Patent
Asahina et al.

(10) Patent No.: US 8,895,217 B2
(45) Date of Patent: Nov. 25, 2014

(54) ELECTROSTATIC IMAGE FORMING TONER AND DEVELOPER

(71) Applicants: Daisuke Asahina, Shizuoka (JP); Tsuyoshi Sugimoto, Shizuoka (JP); Rintaro Takahashi, Miyagi (JP); Hiroshi Yamashita, Shizuoka (JP); Taichi Nemoto, Shizuoka (JP); Shingo Sakashita, Shizuoka (JP); Yoshitaka Yamauchi, Shizuoka (JP); Satoyuki Sekiguchi, Shizuoka (JP)

(72) Inventors: Daisuke Asahina, Shizuoka (JP); Tsuyoshi Sugimoto, Shizuoka (JP); Rintaro Takahashi, Miyagi (JP); Hiroshi Yamashita, Shizuoka (JP); Taichi Nemoto, Shizuoka (JP); Shingo Sakashita, Shizuoka (JP); Yoshitaka Yamauchi, Shizuoka (JP); Satoyuki Sekiguchi, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/751,620

(22) Filed: Jan. 28, 2013

(65) Prior Publication Data

US 2013/0196263 A1 Aug. 1, 2013

(30) Foreign Application Priority Data

Jan. 31, 2012 (JP) ..... 2012-017707

(51) Int. Cl.
*G03G 9/087* (2006.01)
*G03G 9/08* (2006.01)

(52) U.S. Cl.
CPC ..... *G03G 9/08755* (2013.01); *G03G 9/08795* (2013.01); *G03G 9/08797* (2013.01); *G03G 9/0804* (2013.01)
USPC ..... 430/109.4

(58) Field of Classification Search
USPC ..... 430/109.4
See application file for complete search history.

(56) References Cited

U.S. PATENT DOCUMENTS

| | | | | |
|---|---|---|---|---|
| 2008/0050669 | A1 | 2/2008 | Ohmura et al. | |
| 2010/0310980 | A1* | 12/2010 | Sugimoto et al. | 430/108.2 |
| 2011/0065036 | A1* | 3/2011 | Inoue et al. | 430/108.2 |
| 2011/0065039 | A1 | 3/2011 | Ota et al. | |
| 2011/0262856 | A1 | 10/2011 | Sugimoto et al. | |
| 2012/0052431 | A1 | 3/2012 | Hozumi et al. | |
| 2012/0052434 | A1 | 3/2012 | Sugimoto et al. | |
| 2012/0064447 | A1 | 3/2012 | Hozumi et al. | |
| 2012/0065357 | A1 | 3/2012 | Yamauchi et al. | |
| 2012/0082926 | A1 | 4/2012 | Suzuki et al. | |
| 2012/0122027 | A1 | 5/2012 | Watanabe et al. | |
| 2012/0129094 | A1 | 5/2012 | Yamauchi et al. | |
| 2012/0189951 | A1 | 7/2012 | Sugimoto et al. | |
| 2012/0219896 | A1 | 8/2012 | Asahina et al. | |
| 2012/0295193 | A1 | 11/2012 | Hanatani et al. | |
| 2013/0011778 | A1 | 1/2013 | Yamashita et al. | |
| 2013/0157184 | A1* | 6/2013 | Sugimoto et al. | 430/105 |

FOREIGN PATENT DOCUMENTS

| | | | |
|---|---|---|---|
| CN | 102023503 | A | 4/2011 |
| CN | 102243449 | A | 11/2011 |
| JP | 2004-191927 | | 7/2004 |
| JP | 2005-338814 | | 12/2005 |
| JP | 2007-070621 | | 3/2007 |
| JP | 2010-217849 | | 9/2010 |

OTHER PUBLICATIONS

Office Action issued Jul. 3, 2014, in Chinese Patent Application No. 201310037457.5, filed Jan. 31, 2013 w/English translation.

* cited by examiner

*Primary Examiner* — Janis L Dote
(74) *Attorney, Agent, or Firm* — Oblon, Spivak, McClelland, Maier & Neustadt, L.L.P.

(57) ABSTRACT

An electrostatic image forming toner including: toner base particles each containing at least a colorant, a binder resin, and a releasing agent, wherein the binder resin contains a non-crystalline polyester resin A and a crystalline polyester resin B, wherein a ratio of B/(A+B)×100 is 10 or more but less than 50 where (A+B) is a total mass of the non-crystalline polyester resin A and the crystalline polyester resin B and "B" is a mass of the crystalline polyester resin B, and wherein the toner base particles have a TMA compression deformation amount (TMA %) of 10% or less which is measured at 50° C. and a relative humidity of 90%.

9 Claims, No Drawings

ELECTROSTATIC IMAGE FORMING TONER AND DEVELOPER

BACKGROUND OF THE INVENTION

1. Field of the Invention

The present invention relates to an electrostatic image forming toner and developer used in image forming apparatuses such as copiers, printers and facsimiles.

2. Description of the Related Art

With the recent trend toward environmentally sensitive products, techniques of fixing toner with low energy have been demanded.

There are various kinds of such techniques but among others, stronger demand has arisen for electrostatic image forming toner at lower temperatures.

A common method for lowering the fixing temperature of toner is lowering the glass transition temperature of its toner binder. However, simply lowering the glass transition temperature easily causes aggregation of powder (blocking). Aggregation of toner particles in an image forming apparatus impairs the operation of its developing device, so that the operation of the image forming apparatus cannot be continued in some cases. Even if it does not stop the operation of the image forming apparatus, such aggregation of toner particles in a toner-housing container prevents replenishing of toner particles, reducing the toner density to form abnormal images potentially. Suppressing the occurrence of blocking is improving the blocking resistance of toners. In addition, lowering the glass transition temperature of a toner binder also impairs storageability of the toner on the surface of a fixed image. This fixed image tends to melt and be transferred and thus it is attached onto another recording medium stacked thereon, so that the formed image cannot be stored for a long period of time.

The glass transition temperature is a key factor in designing a toner binder. The method of simply lowering the glass transition temperature could not produce a toner fixable by a fixing device set to a lower temperature than before.

Meanwhile, using a crystalline resin as a toner binder has long been known as a method for making blocking resistance and low-temperature fixing property both satisfactory. However, use of the crystalline resin raises a problem that the obtained toner is insufficient in elasticity upon melting to cause hot offset.

As a method for making blocking resistance and low-temperature fixing property both satisfactory, there has been proposed a core-shell toner containing a shell obtained using the melting suspending method or the emulsifying aggregating method (see, for example, Japanese Patent Application Laid-Open (JP-A) Nos. 2007-70621 and 2004-191927). These techniques are still insufficient in order to achieve good blocking resistance while keeping low-temperature fixing property.

Furthermore, a method focusing on a crystalline resin to solve the above problems has been proposed (see JP-A No. 2010-217849). This method has problems that the crystalline resin is susceptible to external conditions (e.g., heat history and/or partial mixing of phases during production, storing and fixing) so that its crystalline structure is not stabilized, which adversely affects various properties of the obtained toner, blocking resistance and stability of the formed image.

SUMMARY OF THE INVENTION

The present invention aims to solve the above existing problems and achieve the following object. Specifically, an object of the present invention is to provide an electrostatic image forming toner excellent in both fixing property and blocking resistance which are in a trade-off relation; i.e., an electrostatic image forming toner keeping its blocking resistance immediately before heating upon fixation and rapidly softens upon heating to enable low-temperature fixation.

Means for solving the above existing problems are as follows.

That is, an electrostatic image forming toner of the present invention includes: toner base particles each containing at least a colorant, a binder resin, and a releasing agent, wherein the binder resin contains a non-crystalline polyester resin A and a crystalline polyester resin B, wherein a ratio of $B/(A+B)\times100$ is 10 or more but less than 50 where (A+B) is a total mass of the non-crystalline polyester resin A and the crystalline polyester resin B and "B" is a mass of the crystalline polyester resin B, and wherein the toner base particles have a TMA compression deformation amount (TMA %) of 10% or less which is measured at 50° C. and a relative humidity of 90%.

The present invention can provide an electrostatic image forming toner excellent in both fixing property and blocking resistance which are in a trade-off relation; i.e., an electrostatic image forming toner keeping its blocking resistance immediately before heating upon fixation and rapidly softens upon heating to enable low-temperature fixation.

DETAILED DESCRIPTION OF THE INVENTION

Embodiments for carrying out the present invention will be described below. Here, it is easy for persons skilled in the art to modify/alter the present invention in the scope of the claims so as to create other embodiments; it should be noted that the scope of the claims includes such modification/alteration, and the following describes exemplary embodiments of the present invention and is not intended to limit the scope of the claims.

(Electrostatic Image Forming Toner)

An electrostatic image forming toner of the present invention (hereinafter referred to simply as "toner") contains at least toner base particles; and, if necessary, further contains other ingredients such as an external additive.

The toner base particles each contain at least a colorant, a binder resin and a releasing agent; and, if necessary, further contain other ingredients such as a charge-controlling agent and a fluidizing agent.

<Binder Resin>

The binder resin contains at least a non-crystalline polyester resin A and a crystalline polyester resin B.

In the binder resin, a ratio of $B/(A+B)\times100$ is 10 or more but less than 50 where (A+B) is a total mass of the non-crystalline polyester resin A and the crystalline polyester resin B and "B" is a mass of the crystalline polyester resin B.

In addition, the toner base particles have a TMA compression deformation amount (TMA %) of 10% or less which is measured at 50° C. and a relative humidity of 90%.

The crystalline polyester resin B is preferably a modified polyester resin having a melting point of 45° C. or higher but lower than 60° C. and containing a urethane bond, a urea bond or both thereof.

Preferably, the non-crystalline polyester resin A and the crystalline polyester resin B are not in a compatible state to the greatest extent possible.

The present inventors conducted extensive studies on a binder resin contributing to improvement in fixing properties (i.e., low-temperature fixing property and offset resistance) and have found that the above object can be achieved by using a binder resin containing a non-crystalline polyester resin A and a crystalline polyester resin B and a ratio of B/(A+B)×100 is 10 or more but less than 50 where (A+B) is a total mass of the non-crystalline polyester resin A and the crystalline polyester resin B and "B" is a mass of the crystalline polyester resin B and by adjusting the TMA compression deformation amount (TMA %) of the toner base particles to 10% or less where the TMA % is measured at 50° C. and a relative humidity of 90%. The present invention has been accomplished on the basis of this finding.

<<Non-Crystalline Polyester Resin A>>

First, the non-crystalline polyester resin A will be described.

The non-crystalline polyester resin A may be a single resin or a plurality of resins and may be any conventionally known resin having a glass transition temperature of 50° C. to 70° C. Preferably, the non-crystalline polyester resin A has a bisphenol skeleton from the viewpoint of beautiful appearance of images. From the viewpoint of emulsifying properties, the non-crystalline polyester resin A preferably has an acid value of 15 mgKOH/g to 20 mgKOH/g.

The non-crystalline polyester resin is produced using a polyhydric alcohol component and a polycarboxylic acid component such as a polycarboxylic acid, a polycarboxylic anhydride or a polycarboxylic acid ester.

Notably, in the present invention, the non-crystalline polyester resin refers to a product obtained as described above using the polyhydric alcohol component and the polycarboxylic acid component such as the polycarboxylic acid, the polycarboxylic anhydride or the polycarboxylic acid ester. The non-crystalline polyester resin does not encompass modified polyester resins such as the below-described prepolymers and resins obtained through crosslinking and/or elongating reaction of the prepolymers.

The polyhydric alcohol component is not particularly limited and may be appropriately selected depending on the intended purpose. Examples thereof include adducts of bisphenol A with alkylene oxides (having 2 or 3 carbon atoms) (average addition mol number: 1 to 10) such as polyoxypropylene(2.2)-2,2-bis(4-hydroxyphenyl)propane and polyoxyethylene(2.2)-2,2-bis(4-hydroxyphenyl)propane; ethylene glycol, propylene glycol, neopentyl glycol, glycerin, pentaerythritol, trimethylol propane, hydrogenated bisphenol A, sorbitol and adducts of them with alkylene oxides (having 2 or 3 carbon atoms) (average addition mol number: 1 to 10). These may be used alone or in combination.

The polycarboxylic acid component is not particularly limited and may be appropriately selected depending on the intended purpose. Examples thereof include dicarboxylic acids such as adipic acid, phthalic acid, isophthalic acid, terephthalic acid, fumaric acid and maleic acid; succinic acid substituted by a C1-C20 alkyl group or a C2-C20 alkenyl group such as dodecenyl succinic acid and octylsuccinic acid; trimellitic acid and pyromellitic acid; anhydrides and alkyl (having 1 to 8 carbon atoms) esters of these acids. These may be used alone or in combination.

The molecular weight of the non-crystalline polyester resin is not particularly limited and may be appropriately selected depending on the intended purpose. When the molecular weight is too low, the formed toner may be poor in heat resistance storage stability and durability to stress such as stirring in the developing device. When the molecular weight is too high, the formed toner may be increased in viscoelasticity during melting, resulting in that it may be degraded in low-temperature fixing property. Preferably, through GPC (gel permeation chromatography), the non-crystalline polyester resin has a weight average molecular weight (Mw) of 3,000 to 15,000, a number average molecular weight (Mn) of 1,000 to 5,000, and a Mw/Mn of 1.0 to 4.0.

The molecular structure of the non-crystalline polyester resin can be confirmed, for example, by NMR (Nuclear Magnetic Resonance) measurement of the non-crystalline polyester resin in a solution or as a solid, as well as by measurement of the non-crystalline polyester resin using X-ray diffraction, GC/MS (Gas Chromatograph Mass Spectrometer), LC/MS (Liquid Chromatograph Mass Spectrometer) or IR (Infrared Spectroscopy). One convenient method therefor is a method of detecting, in the infrared absorption spectrum, the non-crystalline polyester resin on the basis of absorption at wavelengths of 965 $cm^{-1}$±10 $cm^{-1}$ and 990 $cm^{-1}$±10 $cm^{-1}$, which are based on an out-of-plane bending vibration (δCH) of an olefin.

<<Crystalline Polyester Resin B>>

Next, the crystalline polyester resin B will be described.

The crystalline polyester resin B is not particularly limited and may be appropriately selected depending on the intended purpose. The crystalline polyester resin B is preferably composed of a non-linear reactive precursor (i.e., a reaction precursor of the crystalline polyester resin B) and a curing agent. The reaction precursor is a crystalline polyester having, at an end thereof, a reactive site such as isocyanate, epoxy or carbodiimide. In particular, it is preferably a polyester polyurethane having an end that is modified with NCO.

The fact that the crystalline polyester actually has crystallinity can be confirmed based on the melting behaviors and the presence of a melting point observable by DSC.

The melting point can be measured in the following manner, for example. Specifically, using Q2000DSC (product of TA Instruments Co.) with a modulation mode, a sample is heated from 40° C. to 180° C. under $N_2$ flow at 5° C./min. and kept for 5 min. Next, the sample is cooled to 0° C. at 15° C./min. and kept for 5 min. Finally, the sample is heated from 0° C. to 180° C. under $N_2$ flow at 2° C./min. In the process of heating and cooling, the modulation cycle is set to 60 sec and the amplitude is set to 0.5° C. Notably, the melting point (i.e., the maximum endothermic peak temperature) is determined from a non-reversing heat flow curve in the second heating.

Specifically, using an analysis program in the system, the DSC curve in the second heating is selected from the obtained DSC curves, and the maximum peak temperature (melting point) of the sample can be determined from the peak top of the selected DSC curve.

The sample is a polyester resin itself or a reaction precursor treated as follows before measurement. Specifically, 1 g of dibutylamine is added to 10 g of a solution of the reaction precursor, and they are allowed to react for 2 hours. The reaction mixture is dried up in a Petri dish of TEFLON (registered trademark) in vacuum at 80° C. for 5 hours. For a reaction precursor reactive with ketimine, 2 g of ketimine and 2 g of water are added to 10 g of a solution of the reaction precursor, and they are allowed to react for one day. The reaction mixture is dried up in a Petri dish of TEFLON (registered trademark) in vacuum at 80° C. for 5 hours.

A softening point is defined as a temperature at which the flow amount of the sample is ½ when it is heated at a constant heating rate using a flow tester under the following conditions.

Apparatus: FLOW TESTER CTF-500D, product of Shimadzu Corporation

Load: 20 $kgf/cm^2$

Die: 1 mmΦ-1 mm

Heating rate: 6° C./min

Sample amount: 1.0 g

The crystalline polyester B can be obtained through condensation reaction between a divalent or trivalent polycarboxylic acid and a dihydric or trihydric polyalcohol. The crystalline polyester B is not particularly limited and may be a commercially available product or an appropriately synthesized product so long as the effects of the present invention are not impeded.

When the toner of the present invention is produced by the emulsification polymerization method, the reaction precursor of the crystalline polyester resin B is preferably soluble to an organic solvent as described below. In order for it to be soluble to an organic solvent, from the economical viewpoint, the reaction precursor of the crystalline polyester resin B has a polyesterdiol skeleton formed through copolymerization between a polyhydric alcohol component and a polycarboxylic acid component, and the polyhydric alcohol component preferably contains 1,4-cyclohexanedimethanol (CHDM) in an amount of 5 mol % to 30 mol %, more preferably 10 mol % to 20 mol %. Use of such a reaction precursor can yield the crystalline polyester resin B having a polyesterdiol skeleton formed through copolymerization between a polyhydric alcohol component and a polycarboxylic acid component, where the polyhydric alcohol component preferably contains 1,4-cyclohexanedimethanol in an amount of 5 mol % to 30 mol %, more preferably 10 mol % to 20 mol %.

Notably, in the present invention, the fact that the reaction precursor of the crystalline polyester resin B is soluble to an organic solvent was judged based on whether it dissolves in ethyl acetate at normal temperature at a concentration of 30% by mass or higher. The normal temperature was regarded as 25° C. That is, the reaction precursor that dissolves in ethyl acetate at 25° C. at a concentration of 30% by mass or higher is considered being soluble to an organic solvent.

—Polyhydric Alcohol Component—

The polyhydric alcohol component other than 1,4-cyclohexane dimethanol is not particularly limited and may be appropriately selected depending on the intended purpose. Examples thereof include diols and trihydric or higher alcohols.

Examples of the diols include saturated aliphatic diols. Examples of the saturated aliphatic diols include linear saturated aliphatic diols and branched saturated aliphatic diols, with linear saturated aliphatic diols being preferred, with C4-C12 linear saturated aliphatic diols being more preferred. Also, in a case when the number of carbon atoms contained in the main chain thereof is less than 4, when such diols are polycondensated with an aromatic dicarboxylic acid, the formed crystalline polyester resin may increase in melting temperature to prevent low temperature fixing. Whereas, such diols that have carbon atoms exceeding 12 in the main chain thereof are difficult to obtain practically. The number of carbon atoms thereof is more preferably 12 or less.

Examples of the saturated aliphatic diols include ethylene glycol, 1,3-propanediol, 1,4-butanediol, 1,5-pentandiol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosanediol. Among them, preferred are 1,4-butanediol, 1,6-hexanediol, 1,8-octanediol, 1,10-decanediol and 1,12-dodecanediol, since the formed crystalline polyester resin has high crystallinity and excellent sharp melt property.

Examples of the trihydric or higher alcohols include glycerin, trimethylolethane, trimethylolpropane and pentaerythritol.

These may be used alone or in combination.

—Polycarboxylic Acid Component—

The polycarboxylic acid component is not particularly limited and may be appropriately selected depending on the intended purpose. Examples thereof include divalent carboxylic acids and tri- or higher-valent carboxylic acids.

Examples of the divalent carboxylic acids include saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids such as dibasic acids; e.g., phthalic acid, isophthalic acid, terephthalic acid, naphthalene-2,6-dicarboxylic acid, malonic acid and mesaconic acid; and anhydrides or lower alkyl esters thereof.

Examples of the tri- or higher-valent carboxylic acids include 1,2,4-benzenetricarboxylic acid, 1,2,5-benzenetricarboxylic acid and 1,2,4-naphthalenetricarboxylic acid; and anhydrides or lower alkyl esters thereof.

The polycarboxylic acid component may further contain a dicarboxylic acid component having a sulfonic acid group, in addition to the saturated aliphatic dicarboxylic acid and/or the aromatic dicarboxylic acid. Moreover, it may further contain a dicarboxylic acid component having a double bond, in addition to the saturated aliphatic dicarboxylic acid and/or the aromatic dicarboxylic acid.

These may be used alone or in combination.

The crystalline polyester resin B is preferably a modified crystalline polyester resin having a urethane and/or urea group skeleton where the modified crystalline polyester resin is obtained by reacting an amine or a polyol serving as a curing agent with a reaction precursor which is a crystalline polyester having an isocyanate-modified end. For example, the isocyanate component used in the modified crystalline polyester resin is preferably a diisocyanate.

Examples of the diisocyanate include an aromatic diisocyanate having 6 to 20 carbon atoms, an aliphatic diisocyanate having 2 to 18 carbon atoms, an alicyclic diisocyanate having 4 to 15 carbon atoms, an aromatic aliphatic diisocyanate having 8 to 15 carbon atoms, where the number of carbon atoms excludes the carbon atom in the NCO group; a modified product of these diisocyanates (e.g., those containing a urethane group, a carbodiimide group, an allophanate group, a urea group, a biuret group, an uretdione group, an uretoimin group, an isocyanurate group or an oxazolidone group); and a mixture of two or more thereof.

If necessary, a tri- or higher-valent polyisocyanate may be used in combination.

Specific example of the aromatic diisocyanate (including the tri- or higher-valent polyisocyanate) include 1,3- and/or 1,4-phenylene diisocyanate, 2,4- and/or 2,6-tolylene diisocyanate (TDI), crude TDI, 2,4' and/or 4,4'-diphenylmethane diisocyanate (MDI), crude MDI [phosgene compound of crude diaminophenylmethane [condensation product of formaldehyde and aromatic amine (aniline) or a mixture thereof; mixture of diaminodiphenylmethane and a small amount (e.g., 5% by mass to 20% by mass) of a polyamine having three or more functional groups]: polyallyl polyisocyanate (PAPI)], 1,5-naphthylene diisocyanate, 4,4',4"-triphenylmethane diisocyanate, and m- and p-isocyanatophenyl sulfonyl isocyanate.

Specific examples of the aliphatic diisocyanate (including the tri- or higher-valent polyisocyanate) include ethylene diisocyanate, tetramethylene diisocyanate, hexamethylene diisocyanate (HDI), dodecamethylene diisocyanate, 1,6,11-undecene triisocyanate, 2,2,4-trimethylhexamethylene diisocyanate, lysine diisocyanate, 2,6-diisocyanato methylcaproate, bis(2-isocyanatoethyl)fumarate, bis(2-isocyanatoethyl)carbonate and 2-isocyanatoethyl-2,6-diisocyanato hexanoate.

Specific examples of the alicyclic diisocyanate include isophorone diisocyanate (IPDI), dicyclohexylmethane-4,4'-diisocyanate (hydrogenated MDI), cyclohexylene diisocyanate, methyl cyclohexylene diisocyanate (hydrogenated TDI), bis(2-isocyanatoethyl)-4-cyclohexene-1,2-dicarboxylate, and 2,5- and/or 2,6-norbornane diisocyanate.

Specific examples of the aromatic aliphatic diisocyanate include m- and/or p-xylylene diisocyanate (XDI) and α,α,α',α"-tetramethylxylylene diisocyanate (TMXDI).

Examples of the modified product of the diisocyanates include modified products containing a urethane group, a carbodiimide group, an allophanate group, a urea group, a biuret group, an uretdione group, an uretoimin group, an isocyanurate group or an oxazolidone group.

Specific examples thereof include modified diisocyanates such as modified MDIs (e.g., urethane-modified MDIs, carbodiimide-modified MDIs and trihydrocarbyl phosphate-modified MDIs), urethane-modified TDIs and mixtures of two or more thereof [e.g., mixtures of modified MDIs and urethane-modified TDIs (isocyanate-containing prepolymer).

Among them, preferred are an aromatic diisocyanate having 6 to 15 carbon atoms, an aliphatic diisocyanate having 4 to 12 carbon atoms and an alicyclic diisocyanate having 4 to 15 carbon atoms, with TDI, MDI, HDI, hydrogenated MDI and IPDI being particularly preferred.

The crystalline polyester resin B in the present invention preferably has a melting point within the temperature range of 45° C. to 60° C., more preferably 50° C. to 55° C. The crystalline polyester rapidly decreases in viscosity when its temperature exceeds the melting point thereof, and it aggregates to cause blocking when stored at a temperature equal to or higher than the melting point thereof. Hence, the melting point of the crystalline polyester resin B has to be higher than a temperature at which it is stored or used; i.e., 45° C. or higher. Whereas when the melting point is higher than 60° C., low-temperature fixation cannot be achieved. When the melting point of the crystalline polyester resin B is 50° C. to 55° C., the Tg of a non-crystalline portion is close to the Tm of a crystalline portion, and the non-crystalline portion and the crystalline portion have compatibility, so that the toner is excellent in low-temperature fixing property, which is advantageous.

The melting point of the crystalline polyester can be determined as a melting peak temperature measured through the power compensation-type differential scanning calorimetry described in JISK-7121. Notably, although one crystalline resin can show several melting peaks, the maximum peak is regarded as the melting point in this case.

Notably, when the crystalline polyester resin B is composed of the reaction precursor of the crystalline polyester resin B and the curing agent, the melting point of the crystalline polyester resin B is the same as the melting point of the reaction precursor thereof.

The crystalline polyester resin B is a resin obtained by reacting the curing agent with the reaction precursor of the crystalline polyester resin B. The reaction precursor has a polyesterdiol skeleton formed through copolymerization between a polyhydric alcohol component and a polycarboxylic acid component. Preferably, the polyhydric alcohol component in the reaction precursor contains 1,4-cyclohexanedimethanol (CHDM) in an amount of 5 mol % to 30 mol % and the reaction precursor is soluble to an organic solvent. More preferably, the polyhydric alcohol component in the reaction precursor contains 1,4-cyclohexanedimethanol (CHDM) in an amount of 10 mol % to 20 mol %.

When the amount of the CHDM is less than 5 mol %, the reaction precursor cannot have solubility to common-used organic solvents such as ethyl acetate, toluene and tetrahydrofuran, causing localization of the crystalline polyester resin B, which is not preferred. Whereas when the amount of the CHDM is more than 30 mol %, the solubility to an organic solvent can be obtained but the melting point decreases considerably, resulting in that the effects of the present invention cannot be obtained.

The CHDM contained in an amount of 10 mol % to 20 mol % is advantageous in that the crystalline polyester resin B is excellent in solubility to an organic solvent to improve the toner in both storageability and sharp melt property.

The structure of the crystalline polyester resin B contained in the toner can be identified as follows, for example. The crystalline polyester resin B is extracted using an organic solvent (e.g., Soxhlet extraction) and then subjected to thermal characteristics analysis (e.g., DSC) or structural analysis such as GC/MS (pyrolysis GC/MS), NMR or FT-IR.

Conventionally, a crystalline polyester resin has been used like a wax not as a reaction precursor. Specifically, a crystalline aliphatic polyester is crystallized, dispersed and scattered in an attempt of improve low-temperature fixing property. Meanwhile, a non-crystalline polyester resin has conventionally been used as a reaction precursor having NCO at an end thereof. It has been used for improving melt viscosity and other properties to widen a fixing temperature range, rather than used as an agent for promoting low-temperature fixing property. In the present invention, by using as a reaction precursor the crystalline polyester resin B' reaction precursor which is soluble to an organic solvent, it is possible to impart both of the above functions to the obtained toner. That is, in the production process of a toner, the crystalline polyester resin B can be homogeneously mixed and dispersed in each toner particle without a step of crystallizing and dispersing the crystalline polyester resin B, so that the low-temperature fixing property can be improved. In addition, this is advantageous in terms of energy saving since a treatment such as heating is not required upon fixation.

So long as the effects of the present invention are not impeded, post-curing treatments such as addition of a nucleating agent and annealing may be performed after formation of a toner in order to increase crystallinity of the crystalline polyester resin.

The curing agent is not particularly limited and may be appropriately selected depending on the intended purpose. For example, conventionally known amine compounds (a diamine and an optionally used tri- or higher-valent polyamine) can suitably be used.

Examples of the diamine (including the optionally used tri- or higher-valent polyamine) include aliphatic diamines (C2 to C18) and aromatic diamines (C6 to C20).

Examples of the aliphatic diamines (C2 to C18) include [1] (C2 to C6) alkylenediamines (e.g., ethylenediamine, propylenediamine, trimethylenediamine, tetramethylenediamine and hexamethylenediamine) and polyalkylene (C2 to C6) diamines [e.g., diethylenetriamine, iminobispropylamine, bis(hexamethylene)triamine, triethylenetetramine, tetraethylenepentamine and pentaethylenehexamine]); [2] alkyl (C1 to C4) or hydroxyalkyl (C2 to C4)-substituted products thereof [e.g., dialkyl (C1 to C3) aminopropylamine, trimethylhexamethylenediamine, aminoethylethanolamine, 2,5-dimethyl-2,5-hexamethylenediamine and methyliminobispropylamine]; [3] aliphatic ring-containing or heterocyclic ring-containing aliphatic diamines (alicyclic diamines (C4 to C15) [e.g., 1,3-diaminocyclohexane, isophorondiamine, menthene diamine, 4,4'-methylenedicyclohexanediamine (e.g., hydrogenerated methylenedianiline)], heterocyclic diamines (C4 to C15) [e.g., piperadine, N-aminoethylpiperadine, 1,4-diaminoethylpiperadine, 1,4-bis(2-amino-2-methylpropyl)piperadine and 3,9-bis(3-aminopropyl)-2,4,8,10-tetraoxaspiro[5,5]undecane]; and [4] aromatic ring-containing aliphatic amines (C8 to C15) (e.g., xylylenediamine and tetrachloro-p-xylylenediamine).

Examples of the aromatic diamines (C6 to C20) include

[1]: unsubstituted aromatic diamines [e.g., 1,2-, 1,3- and 1,4-phenylenediamines, 2,4'- and 4,4'-diphenylmethanediamines, crude diphenylmethanediamine (polyphenylpolymethylenepolyamine), diaminodiphenylsulfone, benzidine, thiodianiline, bis(3,4-diaminophenyl) sulfone, 2,6-diaminopyridine, m-aminobenzylamine, triphenylmethane-4,4',4"-triamine and naphthylenediamine];

[2]: aromatic diamines having nuclear-substituted alkyl groups [e.g., C1 to C4 alkyl groups such as methyl, ethyl, n- or i-propyl and butyl] such as 2,4- and 2,6-tolylenediamine, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenyl ether and 3,3',5,5'-tetraisopropyl-4,4'-diaminodiphenylsulfone] and mixtures containing their isomers at various ratios;

[3]: aromatic diamines having nuclear-substituted electron-attracting groups (e.g., halogen atoms such as Cl, Br, I and F; alkoxy groups such as methoxy and ethoxy; and a nitro group) [methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline; 4,4'-diamino-3,3'-dimethyl-5,5'-dibromo-diphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl) sulfide, bis(4-aminophenyl)telluride, bis(4-aminophenyl) selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline) and 4-aminophenyl-2-chloroaniline];

[4]; aromatic diamines having a secondary amino group [which are the aromatic diamines listed in the above [1] to [3] part or all of the —$NH_2$ of which have been changed to —NH—R' (where R' is an alkyl group such as lower alkyl groups (e.g., methyl and ethyl)] such as 4,4'-di(methylamino)diphenylmethane and 1-methyl-2-methylamino-4-aminobenzene.

In addition to the above-listed amines, further examples of the diamine component include polyamidepolyamines [e.g., low-molecular-weight polyamidepolyamines obtained through condensation of a dicarboxylic acid (e.g., dimer acids) and an excess amount (2 mol or more per 1 mol of an acid) of polyamines (e.g., the above alkylene diamines and polyalkylenepolyamines)] and polyetherpolyamines [hydrides of cyanoethylated products of polyetherpolyols (e.g., polyalkyleneglycol)].

Thermal properties of the toner will be described.

The toner of the present invention has to have thermal properties that the toner base particles have a TMA (Thermo Mechanical Analysis) compression deformation amount (TMA %) of 10% or less which is measured at 50° C. and a relative humidity of 90%. The TMA % exceeding 10% means that the toner can easily deform when transported in summer or by ship. It specifically means that even if the toner is excellent in static storageability measured by, for example, the penetration test and excellent in storageability under dry conditions, the toner is poor in storageability under dynamic conditions including error factors. That is, the toner containing the toner base particles having a TMA % exceeding 10% is poor in blocking resistance. In other words, considering, for example, the transportation or storage in a storehouse of the toner in summer and the temperature inside copiers, the TMA % exceeding 10% is not preferred since the toner particles easily adhere to each other to be degraded in transportability and transferability, directly leading to image failures or other failures. The TMA % measured at 50° C. is preferably 7% or less.

The TMA % can be controlled by adjusting, for example, the ratio between the amount of the non-crystalline polyester resin A and the amount of the crystalline polyester resin B in the toner base particles, and the melting point and structure of the crystalline polyester resin B. The TMA % of 10% or less can be attained as follows. Specifically, the end of a crystalline polyester having a melting point falling within a specific temperature range is modified with NCO, and the resultant crystalline polyester is then reacted in particles so as to have a structure like an inter penetrated polymer network (IPN), so that the obtained toner has a property like a compatible system although the non-crystalline polyester resin A and the crystalline polyester resin B are in a non-compatible state.

Notably, the toner base particles refer to a toner or toner particles to which the external additive(s) is not added; i.e., before addition of the external additive(s).

The toner of the present invention is not particularly limited and may be appropriately selected depending on the intended purpose so long as the ratio of $B/(A+B)\times100$ is 10 or more but less than 50 where (A+B) is a total mass of the non-crystalline polyester resin A and the crystalline polyester resin B and "B" is a mass of the crystalline polyester resin B. The ratio of $B/(A+B)\times100$ is preferably 15 to 20.

When the ratio of $B/(A+B)\times100$ is 10 or more but less than 50, the toner does not melt in an environment in which it is stored and does not melt with stirring in a developing device. The toner rapidly decreases in viscoelasticity in a predetermined temperature range, so that it can be excellent in both low-temperature fixing property and blocking resistance. When the ratio of $B/(A+B)\times100$ of the toner is less than 10, the blocking resistance is good and the toner particles do not aggregate but the low-temperature fixing property cannot be obtained to be poor in fixability. Whereas when the ratio of $B/(A+B)\times100$ of the toner is 50 or more, the low-temperature fixing property is good but the blocking resistance is poor, so that the toner particles form aggregates in the image forming apparatus. The ratio of $B/(A+B)\times100$ of 15 to 20 is advantageous in terms of: a favorable balance between low-temperature fixing property and storageability; cost; and productivity.

The binder resin may contain other resins that the non-crystalline polyester resin A and the crystalline polyester resin B. However, the total amount of the non-crystalline polyester resin A and the crystalline polyester resin B in the binder resin is preferably 80% by mass or more.

Besides, the toner of the present invention may contain the following materials. The toner of the present invention can be formed by mixing or polymerizing the binder resin, colorant and releasing agent. If necessary, other ingredients such as a charge-controlling agent and a fluidizing agent may be incorporated into the toner.

<Colorant>

The colorant is not particularly limited and may appropriately be selected from all kinds of dyes and pigments used as a colorant for a toner. Examples thereof include carbon black, iron black, sudan black SM, fast yellow G, benzidine yellow, solvent yellow (e.g., 21, 77 and 114), pigment yellow (e.g., 12, 14, 17 and 83), indofast orange, irgazin red, para-nitroaniline red, toluidine red, solvent red (e.g., 17, 49, 128, 5, 13, 22 and 48.2), disperse red, carmine FB, pigment orange R, lake red 2G, rhodamine FB, rhodamine B lake, methylviolet B lake, phthalocyanine blue, solvent blue (e.g., 25, 94, 60 and 15.3), pigment blue, brilliant green, phthalocyanine green, oil yellow GG, kayaset YG, orasol brown B and oil pink OP. These may be used alone or in combination. If necessary, magnetic powders (e.g., powders of ferromagnetic metals such as iron, cobalt and nickel, or compounds such as magnetite, hematite and ferrite) may be added for them to serve also as a coloring agent. The amount of the colorant is preferably 0.1 parts by mass to 40 parts by mass, more preferably 0.5 parts by mass to 10 parts by mass, with respect to 100 parts by mass of the toner binder in the present invention. When a magnetic powder is used, the amount is preferably 20 parts by mass to 150 parts by mass, more preferably 40 parts by mass to 120 parts by mass, with respect to 100 parts by mass of the toner binder in the present invention.

<Releasing Agent>

The releasing agent is not particularly limited and may be appropriately selected depending on the intended purpose, but preferably has a softening point of 50° C. to 170° C. Examples of such a releasing agent include polyolefin wax, natural wax (e.g., carnauba wax, montan wax, paraffin wax and rice wax), aliphatic alcohols having 30 to 50 carbon atoms (e.g., triacontanol), fatty acids having 30 to 50 carbon atoms (e.g., triacontane carboxylic acid) and mixtures thereof. Examples of the polyolefin wax include (co)polymers of olefins (e.g., ethylene, propylene, 1-buthene, isobutylene, 1-hexene, 1-dodecene, 1-octadecene and mixtures thereof) [including those obtained through (co)polymerization and heat degradation-type polyolefins], oxides of (co) polymers of olefins by oxygen and/or ozone, maleic acid-modified products of (co)polymers of olefins [e.g., modified products of maleic acid and its derivatives (maleic anhydride, monomethyl maleate, monobutyl maleate and dimethyl maleate)], copolymers of olefins and unsaturated carboxylic acids [e.g., (meth)acrylic acid, itaconic acid and maleic anhydride] and/or unsaturated carboxylic acid alkyl esters [e.g., (meth)acrylic acid alkyl (the alkyl of which having 1 to 18 carbon atoms) ester and maleic acid alkyl (the alkyl of which having 1 to 18 carbon atoms) ester], polymethylene (e.g., Fischer-Tropsch wax such as SASOLWAX), metal salts of fatty acids (e.g., calcium stearate) and fatty acid esters (e.g., behenyl behenate).

<Other Ingredients>

<<Charge-Controlling Agent>>

The charge-controlling agent is not particularly limited and may be appropriately selected depending on the intended purpose. Examples thereof include nigrosine dyes, triphenylmethane dyes containing a tertiary amine as a side chain, quaternary ammonium salts, polyamine resins, imidazole derivatives, quaternary ammonium base-containing polymers, metal-containing azo dyes, copper phthalocyanine dyes, metal salts of salicylic acid, boron complexes of benzylic acid, sulfonic acid group-containing polymers, fluorine-containing polymers, halogen-substituted aromatic ring-containing polymers, metal complexes of alkyl derivatives of salicylic acid and cetyltrimethyl ammonium bromide.

<<Fluidizing Agent>>

The fluidizing agent is not particularly limited and may be appropriately selected depending on the intended purpose. Examples thereof include colloidal silica, alumina powder, titanium oxide powder, calcium carbonate powder, barium titanate, magnesium titanate, calcium titanate, strontium titanate, zinc oxide, silica sand, clay, mica, wollastonite, diatom earth, chromium oxide, cerium oxide, colcothar, antimony trioxide, magnesium oxide, zirconium oxide, barium sulfate and barium carbonate.

Regarding their compositional ratio when forming a toner, the amount of the binder resin is preferably 30% by mass to 97% by mass, more preferably 40% by mass to 95% by mass, particularly preferably 45% by mass to 92% by mass, relative to the amount of the toner; and the amount of the colorant is preferably 0.05% by mass to 60% by mass, more preferably 0.1% by mass to 55% by mass, particularly preferably 0.5% by mass to 50% by mass, relative to the amount of the toner. Among the additives, the amount of the releasing agent is preferably 0% by mass to 30% by mass, more preferably 0.5% by mass to 20% by mass, particularly preferably 1% by mass to 10% by mass, relative to the amount of the toner; the amount of the charge-controlling agent is preferably 0% by mass to 20% by mass, more preferably 0.1% by mass to 10% by mass, particularly preferably 0.5% by mass to 7.5% by mass, relative to the amount of the toner; and the amount of the fluidizing agent is preferably 0% by mass to 10% by mass, more preferably 0% by mass to 5% by mass, particularly preferably 0.1% by mass to 4% by mass, relative to the amount of the toner. The total amount of the additives is preferably 3% by mass to 70% by mass, more preferably 4% by mass to 58% by mass, particularly preferably 5% by mass to 50% by mass, relative to the amount of the toner.

When the amounts of the above materials (i.e., the compositional ratio of the toner) fall within the above ranges, it is possible to easily obtain a toner having good charging property.

[Method for Producing the Toner]

A method for producing a toner of the present invention produces a toner containing the non-crystalline polyester resin A and the crystalline polyester resin B as main binder resins.

The method for producing a toner is not particularly limited and may be appropriately selected and may be appropriately selected depending on the intended purpose. Examples thereof include the kneading pulverizing method where a binder resin is melt-kneaded together with a colorant and other ingredients and the resultant mixture is finely pulverized and further classified, and the emulsification polymerization aggregation method and the suspension polymerization method where granulation is performed in a solvent such as an aqueous phase. In the suspension polymerization method, for example, a monomer, a polymerization initiator, a colorant, a releasing agent and other ingredients are added under stirring to an aqueous phase containing a dispersion stabilizer to form oil droplets, followed by heating to perform polymerization reaction, whereby toner particles are produced. In the emulsification polymerization aggregation method, for example, a polyester resin used as a binder resin is emulsified and dispersed in an aqueous phase, followed by desolvating, and the resultant particles and a colorant, a releasing agent (wax) and other ingredients are dispersed in an aqueous phase and the formed dispersoids are aggregated and fused with heating, whereby toner particles are produced. The method for producing the toner of the present invention is not particularly limited and may be any production method so long as the toner is formed using the non-crystalline polyester resin A and the crystalline polyester resin B as main binder resins.

The toner of the present invention may be a toner produced by any conventionally known methods such as the above-described kneading pulverizing method, phase-inversion emulsification method and polymerization method. For example, when the toner is obtained by the kneading pulverizing method, toner materials except a fluidizing agent are blended through a dry process and the resultant blend is melt-kneaded, then roughly pulverized, finally finely pulverized using, for example, a jet mill, and further classified to form particles preferably having a volume average particle diameter of 5 μm to 20 μm, followed by mixing with a fluidizing agent. Notably, the volume average particle diameter is measured using a Coulter counter [e.g., trade name: MULTISIZER III (product of Beckman Coulter Ltd.)].

When the toner is obtained by the phase-inversion emulsification method, toner materials except a fluidizing agent are dissolved or dispersed in an organic solvent and the resultant solution or dispersion liquid is emulsified by, for example, the addition of water, followed by separation and classification. Alternatively, the toner may be produced by the method using organic particles described in JP-A No. 2002-284881. The volume average particle diameter of the toner is preferably 3 μm to 15 μm.

The toner of the present invention may be any conventionally known method as described above. Preferably, it is granulated by dispersing, in an aqueous medium, an oil phase containing at least the non-crystalline polyester resin A, the crystalline polyester resin B and/or the reaction precursor thereof, the releasing agent and the colorant.

Furthermore, the granulation in the aqueous medium is preferably performed by: dispersing, in the aqueous medium, the oil phase prepared by dissolving or dispersing in an organic solvent at least the non-crystalline polyester resin A, the reaction precursor of the crystalline polyester resin B, the releasing agent and the colorant, to thereby prepare a dispersion liquid; allowing the reaction precursor of the crystalline polyester resin B to undergo crosslinking or elongating reaction with a curing agent in the dispersion liquid; and removing the organic solvent from the dispersion liquid.

—Preparation of Aqueous Medium (Aqueous Phase)—

The aqueous medium can be prepared by, for example, dispersing conventionally used resin particles well known in the art in an aqueous medium. The amount of the resin particles added in the aqueous medium is not particularly limited and may be appropriately selected depending on the intended purpose, but is preferably 0.5% by mass to 10% by mass.

The aqueous medium is not particularly limited and may be appropriately selected depending on the intended purpose. Examples thereof include water, water-miscible solvents and mixtures thereof. These may be used alone or in combination.

Among them, water is preferred.

The water-miscible solvent is not particularly limited and may be appropriately selected depending on the intended purpose. Examples thereof include alcohols, dimethylformamide, tetrahydrofuran, cellsolves and lower ketones. The alcohol is not particularly limited and may be appropriately selected depending on the intended purpose. Examples thereof include methanol, isopropanol and ethylene glycol. The lower ketone is not particularly limited and may be appropriately selected depending on the intended purpose. Examples thereof include acetone and methyl ethyl ketone.

—Preparation of Oil Phase—

The oil phase containing toner materials can be prepared by dissolving or dispersing in an organic solvent toner materials including the non-crystalline polyester resin A, the crystalline polyester resin B and/or the reaction precursor thereof, the releasing agent and the colorant.

The organic solvent is not particularly limited and may be appropriately selected depending on the intended purpose, but is preferably an organic solvent having a boiling point of lower than 150° C. in terms of easy removal.

The organic solvent having a boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These solvents may be used alone or in combination.

Among them, ethyl acetate, toluene, xylene, benzene, methylene chloride, 1,2-dichloroethane, chloroform and carbon tetrachloride are preferred, and ethyl acetate is more preferred.

—Dispersion of Oil Phase—

The oil phase containing the toner materials is dispersed in the aqueous medium (step 1: preparation of the dispersion liquid).

In dispersing the oil phase, the reaction precursor of the crystalline polyester resin B is allowed to undergo crosslinking and/or elongating reaction with a curing agent, whereby the crystalline polyester resin B is formed (step 2: crosslinking and/or elongating reaction).

The crystalline polyester resin B is preferably formed by, for example, dissolving or dispersing in the aqueous medium the oil phase containing the reaction precursor having an isocyanate group and the curing agent such as amines and allowing the reaction precursor and the curing agent to undergo crosslinking and/or elongating reaction in the aqueous medium. In another employable method, the crystalline polyester resin B is formed by dissolving or dispersing the oil phase containing the toner materials in the aqueous medium previously containing the curing agent and allowing the toner materials and the curing agent to undergo crosslinking and/or elongating reaction in the aqueous medium. In still another employable method, the crystalline polyester resin B is formed from the surfaces of particles by dispersing the oil phase containing the toner materials in the aqueous medium, adding the curing agent to the aqueous medium, and allowing the toner materials and the curing agent to undergo crosslinking and/or elongating reaction in the aqueous medium.

The reaction conditions for forming the crystalline polyester resin B (reaction time and reaction temperature) are not particularly limited and may be appropriately selected depending on the combination of the curing agent and the reaction precursor.

The reaction time is not particularly limited and may be appropriately selected depending on the intended purpose, but is preferably 10 min to 40 hours, more preferably 2 hours to 24 hours.

The reaction temperature is not particularly limited and may be appropriately selected depending on the intended purpose, but is preferably 0° C. to 150° C., more preferably 15° C. to 40° C.

The method for stably dispersing the reaction precursor in the aqueous medium to form a dispersion liquid is not particularly limited and may be appropriately selected depending on the intended purpose. Examples thereof include a method where the oil phase prepared by dissolving or dispersing toner materials in an organic solvent is added to the aqueous medium and dispersed with shearing force.

The disperser used for the above dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser.

Among them, a high-speed shearing disperser is preferred since it can adjust dispersoids (oil droplets) so as to have a particle diameter of 2 μm to 20 μm.

In use of the high-speed shearing disperser, the conditions such as rotating speed, dispersion time and temperature during dispersing may be appropriately selected depending on the intended purpose.

The rotating speed is not particularly limited and may be appropriately selected depending on the intended purpose, but is preferably 1,000 rpm to 30,000 rpm, more preferably 5,000 rpm to 20,000 rpm.

The dispersion time is not particularly limited and may be appropriately selected depending on the intended purpose, but is preferably 0.1 min to 5 min when a batch method is employed.

The temperature during dispersing is not particularly limited and may be appropriately selected depending on the intended purpose, but is preferably 0° C. to 150° C. under pressure, more preferably 15° C. to 40° C. under pressure. The higher the temperature during dispersion is, the easier the dispersing is to perform.

The amount of the aqueous medium in which the oil phase containing the toner materials dissolved or dispersed therein is to be dispersed is not particularly limited and may be appropriately selected depending on the intended purpose, but is preferably 50 parts by mass to 2,000 parts by mass, more preferably 100 parts by mass to 1,000 parts by mass, relative to 100 parts by mass of the toner materials.

When the amount of the aqueous medium is less than 50 parts by mass, the dispersion state of the toner materials is poor, so that toner base particles having an intended particle diameter cannot be obtained in some cases. Whereas when it is more than 2,000 parts by mass, production cost may be elevated.

In dispersing the oil phase containing the toner materials, a dispersing agent is preferably used from the viewpoint of stabilizing dispersoids such as oil droplets so as to have a desired shape and obtain a sharp particle size distribution.

The dispersing agent is not particularly limited and may be appropriately selected depending on the intended purpose. Examples thereof include a surfactant, a poorly-water-soluble inorganic compound dispersing agent and a polymer protective colloid. These may be used alone or in combination.

Among them, a surfactant is preferred.

The surfactant is not particularly limited and may be appropriately selected depending on the intended purpose. Examples thereof include an anionic surfactant, a cationic surfactant, a nonionic surfactant and an amphoteric surfactant.

The anionic surfactant is not particularly limited and may be appropriately selected depending on the intended purpose. Examples thereof include alkylbenzenesulfonic acid salts, α-olefinsulfonic acid salts and phosphoric acid esters.

Among them, those containing a fluoroalkyl group are preferred.

A catalyst may be used for the elongating and/or crosslinking reaction in forming the crystalline polyester resin B.

The catalyst is not particularly limited and may be appropriately selected depending on the intended purpose. Examples thereof include dibutyltin laurate and dioctyltin laurate.

—Removal of the Organic Solvent (Step 3)—

The method for removing the organic solvent from the dispersion liquid such as the emulsified slurry is not particularly limited and may be appropriately selected depending on the intended purpose. Examples thereof include a method where the entire reaction system is gradually increased in temperature to evaporate the organic solvent contained in the oil droplets and a method where the dispersion liquid is sprayed toward a dry atmosphere to remove the organic solvent contained in the oil droplets.

After the organic solvent has been removed, toner base particles are formed. The toner base particles may be subjected to, for example, washing and drying, and further to classification. This classification may be performed by removing unnecessary fine particles using, for example, a cyclone, a decanter or a centrifuge in the liquid. Alternatively, it may be performed after drying of the toner base particles.

The obtained toner base particles may be mixed with other particles such as an external additive and the charge-controlling agent. In this mixing, application of mechanical impact can prevent the other particles such as the external additive from being exfoliated from the surfaces of the toner base particles.

The method for applying mechanical impact is not particularly limited and may be appropriately selected depending on the intended purpose. Examples thereof include a method where an impact is applied to a mixture using a high-speed rotating blade and a method where a mixture is caused to pass through a high-speed airflow for acceleration and particles are crushed against each other or against an appropriate collision plate.

The apparatus used for the above methods is not particularly limited and may be appropriately selected depending on the intended purpose. Examples thereof include: ONGMILL (product of Hosokawa Micron Corp., Ltd.); an apparatus produced by modifying an I-type mill (product of NIPPON NEUMATIC MFG. CO., LTD.) so that the pulverizing air pressure thereof is decreased; HYBRIDIZATION SYSTEM (product of Nara Machinery Co., Ltd.); CRYPTRON SYSTEM (product of Kawasaki Heavy Industries, Ltd.); and an automatic mortar.

(Developer)

A developer of the present invention contains at least the electrostatic image forming toner of the present invention; and, if necessary, further contains other ingredients.

The developer may be a one-component developer or a two-component developer. When the developer is a two-component developer, the toner of the present invention may be mixed with a carrier in use. When the developer is a one-component developer, the toner of the present invention may be used as a one-component magnetic or non-magnetic toner.

If necessary, the toner may be mixed with carrier particles (iron powder, glass beads, nickel powder, ferrite, magnetite and ferrite whose surface has been coated with a resin (e.g., an acrylic resin or a silicone resin)) and used as a developer for forming an electrically latent image. Also, an electrically latent image may be formed by friction using, for example, a charged blade in place of carrier particles.

The electrically latent image is then fixed on a support (e.g., paper or a polyester film) using, for example, a known heating roll fixing method.

EXAMPLES

The present invention will next be described in more detail by way of Examples, which should not be construed as limiting the present invention thereto.

In the following Examples, the unit "%" means "% by mass."

Synthesis Example 1

—Synthesis of Non-Crystalline Polyester Resin A—

A 5 L four-necked flask equipped with a nitrogen-introducing tube, a dehydration tube, a stirrer and a thermocouple was charged with a bisphenol A ethylene oxide 2 mol adduct and a bisphenol A propylene oxide 3 mol adduct which were in a molar ratio of 85/15 (the bisphenol A ethylene oxide 2 mol adduct/the bisphenol A propylene oxide 3 mol adduct) and isophthalic acid and adipic acid which were in a molar ratio of 80/20 (isophthalic acid/adipic acid) so that an equivalent ratio (OH/COOH) of the hydroxyl group [OH] of a polyol to the carboxyl group [COOH] of a polycarboxylic acid was 1.3. The materials were allowed to react at 230° C. for 10 hours under normal pressure together with titaniumtetraisopropoxide of 500 ppm, and further react at a reduced pressure of 10 mmHg to 15 mmHg for 5 hours. Then, 30 parts of trimellitic anhydride was added to the reaction container, followed by reaction at 180° C. for 3 hours under normal pressure, to thereby obtain non-crystalline polyester resin A. The properties of the non-crystalline polyester resin A are presented in Table 1. The glass transition temperature (Tg) of the non-crystalline polyester resin A was found to be 48.5° C.

Synthesis Example 2

—Synthesis of Reaction Precursor of Crystalline Polyester Resin B—

A 5 L four-necked flask equipped with a nitrogen-introducing tube, a dehydration tube, a stirrer and a thermocouple which had been dried with heating was charged with sebacic acid and an alcohol mixture of 1,6-hexanediol (HD) and 1,4-cyclohexanedimethanol (CHDM), which were in a molar ratio of 95/5, so that the OH/COOH was 1.12. The materials were allowed to react at 200° C. to 230° C. for 10 hours under normal pressure together with titaniumtetraisopropoxide of 500 ppm, and further react at a reduced pressure of 10 mmHg to 15 mmHg for 5 hours, to thereby obtain a crystalline aliphatic polyester. The crystalline polyester was dissolved in ethyl acetate at a concentration of 50%. Then, 4,4'-diphenylmethane diisocyanate (MDI) was added to the resultant solution so that an equivalent ratio (NCO/OH) of the isocyanate group [NCO] of a polyisocyanate to the hydroxyl group [OH] of a polyol was 2.1. The mixture was allowed to react for 3 hours under reflux to thereby obtain a solution of a reaction precursor of crystalline polyester resin B-1 (solid content concentration: about 50%). The obtained reaction precursor of crystalline polyester resin B-1 was found to have a melting point (Tm) of 55° C.

Example 1

In the below-described manner, a toner was prepared using the non-crystalline polyester resin A obtained in Synthesis Example 1 and the solution of the reaction precursor of crystalline polyester resin B-1 obtained in Synthesis Example 2. The properties thereof are presented in Table 1, indicating that it was possible to obtain a high-quality toner excellent in both low-temperature fixing property and blocking resistance.

<Preparation of Toner>

—Synthesis of Ketimine—

A reaction container equipped with a stirring rod and a thermometer was charged with 170 parts of isophorone diisocyanate and 75 parts of methyl ethyl ketone, followed by reaction at 50° C. for 5 hours, to thereby obtain [ketimine compound 1]. The amine value of the obtained [ketimine compound 1] was found to be 418.

—Preparation of Masterbatch (MB)—

Water (1,200 parts), 540 parts of carbon black (PRINTEX35, product of Evonik Degussa) [DBP oil absorption amount=42 mL/100 mg, pH=9.5] and 1,200 parts of the [non-crystalline polyester resin A] were mixed together with HENSCHEL MIXER (product of NIPPON COKE & ENGINEERING CO., LTD.). The resultant mixture was kneaded at 150° C. for 30 min with a twin roll, and then rolled, cooled and pulverized with a pulverizer, to thereby produce [masterbatch 1].

—Preparation of Pigment•WAX Dispersion Liquid—

A container to which a stirring rod and a thermometer had been set was charged with 378 parts of the [non-crystalline polyester resin A], 50 parts of paraffin wax as a releasing agent 1 (product of NIPPON SEIRO CO., LTD., HNP-9, hydrocarbon wax, melting point: 75° C., SP value: 8.8), 22 parts of a charge-controlling agent (salicylic acid metal complex, BONTRON E-84: product of Orient Chemical Industries Co., Ltd.) and 947 parts of ethyl acetate. The mixture was increased in temperature to 80° C. under stirring, kept at 80° C. for 5 hours and cooled to 30° C. for 1 hour. Then, the container was charged with 500 parts of the [masterbatch 1] and 500 parts of ethyl acetate, followed by mixing for 1 hour, to thereby obtain [raw material solution].

The [raw material solution] (1,324 parts) was placed in a container and dispersed with a bead mill (ULTRA VISCOMILL, product of AIMEX CO., Ltd.) under the following conditions: liquid-feeding rate: 1 kg/h; disc circumferential speed: 6 m/sec; the amount of zirconia beads having a particle diameter of 0.5 mm packed: 80% by volume; pass time: 3. Next, 1,042.3 parts of a 65% ethyl acetate solution of the [non-crystalline polyester resin A] was added to the container and the resultant mixture was passed once with the beads mill under the above conditions, whereby [pigment•WAX dispersion liquid] was obtained. The solid content concentration of the [pigment•WAX dispersion liquid] was found to be 50% (130° C., 30 min).

—Preparation of Oil Phase—

A container to which a stirring rod and a thermometer had been set was charged with 664 parts of the [pigment•WAX dispersion liquid], 150 parts of the [solution of a reaction precursor of crystalline polyester resin B-1] and 4.6 parts of the [ketimine compound 1], and the materials were mixed together using a TK homomixer (product of PRIMIX Corporation) at 5,000 rpm for 1 min, whereby [oil phase] was obtained.

—Synthesis of Organic Particle Emulsion (Particle Dispersion Liquid)—

A reaction container to which a stirring rod and a thermometer had been set was charged with 683 parts of water, 11 parts of sodium salt of sulfuric acid ester of ethylene oxide adduct of methacrylic acid (ELEMINOL RS-30, product of Sanyo Chemical Industries Ltd.), 138 parts of styrene, 138 parts of methacrylic acid and 1 part of ammonium persulfate. The resultant mixture was stirred at 400 rpm for 15 min to thereby obtain a white emulsion. The white emulsion was heated to a system temperature of 75° C. and was allowed to react for 5 hours. Then, 30 parts of a 1% by mass aqueous ammonium persulfate solution was added to the reaction mixture, followed by aging at 75° C. for 5 hours, to thereby obtain an aqueous dispersion [particle dispersion liquid] of a vinyl resin (a copolymer of styrene-methacrylic acid-sodium salt of sulfuric acid ester of methacrylic acid-ethylene oxide adduct). The volume average particle diameter of the obtained [particle dispersion liquid] was found to be 0.14 μm, when measured using LA-920 (product of Horiba, Ltd.). Part of the [particle dispersion liquid] was dried to isolate resin.

—Preparation of Aqueous Phase—

Water (990 parts), 83 parts of the [particle dispersion liquid], 37 parts of a 48.5% aqueous solution of sodium dodecyldiphenyl ether disulfonate (ELEMINOL MON-7, product of Sanyo Chemical Industries Ltd.) and 90 parts of ethyl acetate were stirred and mixed together to thereby obtain a milky white liquid, which was used as [aqueous phase].

—Emulsification and Desolvation—

The [aqueous phase] (1,200 parts) was added to a container containing the [oil phase], and the mixture was mixed using a TK homomixer at 13,000 rpm for 20 min, whereby [emulsified slurry] was obtained.

The [emulsified slurry] was charged into a container to which a stirrer and a thermometer had been set, desolvated at 30° C. for 8 hours and aged at 40° C. for 10 hours, whereby [dispersion slurry] was obtained.

—Washing and Drying—

The [dispersion slurry] (100 parts) was filtrated under reduced pressure and then subjected to the following washing and drying treatments.

(1): Ion-exchanged water (100 parts) was added to the filtration cake and the mixture was mixed using a TK homomixer (12,000 rpm, 10 min), followed by filtration.

(2): A 10% aqueous sodium hydroxide solution (100 parts) was added to the filtration cake obtained in (1) and the mixture was mixed using a TK homomixer (12,000 rpm, 30 min), followed by filtration under reduced pressure.

(3): 10% hydrochloric acid (100 parts) was added to the filtration cake obtained in (2) and the mixture was mixed using a TK homomixer (12,000 rpm, 10 min), followed by filtration.

(4): Ion-exchanged water (300 parts) was added to the filtration cake obtained in (3) and the mixture was mixed using a TK homomixer (12,000 rpm, 10 min), followed by filtration.

The above treatments (1) to (4) were performed twice to thereby obtain [filtration cake].

The [filtration cake] was dried using an air-circulation dryer at 45° C. for 48 hours and sieved with a mesh having an opening of 75 μm, whereby [toner base particles] were obtained.

Example 2

A solution of a reaction precursor of crystalline polyester resin B-2 was prepared in the same manner as in "Synthesis of reaction precursor of crystalline polyester resin B" of Synthesis Example 2 except that the molar ratio of HD/CHDM was 85/15. In addition, a toner was produced in the same manner as in Example 1 except that the solution of a reaction precursor of crystalline polyester resin B-1 was changed to the solution of a reaction precursor of crystalline polyester resin B-2. The properties thereof are presented in Table 1, indicating that it was possible to obtain a high-quality toner excellent in both low-temperature fixing property and blocking resistance. Notably, the crystalline polyester resin B-2 obtained in this manner was found to have a melting point of 51° C.

Example 3

A solution of a reaction precursor of crystalline polyester resin B-3 was prepared in the same manner as in "Synthesis of reaction precursor of crystalline polyester resin B" of Synthesis Example 2 except that the molar ratio of HD/CHDM was 70/30. In addition, a toner was produced in the same manner as in Example 1 except that the solution of a reaction precursor of crystalline polyester resin B-1 was changed to the solution of a reaction precursor of crystalline polyester resin B-3. The properties thereof are presented in Table 1, indicating that it was possible to obtain a high-quality toner excellent in both low-temperature fixing property and blocking resistance. Notably, the crystalline polyester resin B-3 obtained in this manner was found to have a melting point of 47° C.

Example 4

A toner was produced in the same manner as in Example 2 except that the ratio of the crystalline polyester B expressed by B/(A+B)×100 was changed to 45 while the total amount of the non-crystalline polyester resin A and the crystalline polyester resin B contained in the toner was maintained. Specifically, in the preparation of oil phase, the amounts of the [pigment•WAX dispersion liquid] and the [solution of a reaction precursor of crystalline polyester resin B-2] were adjusted and the [ketimine compound 1] was added in such an amount that the amount by mol of isophorondiamine eliminated as a result of reaction with water was 1.1 times the amount by mol of the NCO. The properties thereof are presented in Table 1, indicating that it was possible to obtain a high-quality toner excellent in both low-temperature fixing property and blocking resistance.

Example 5

A toner was produced in the same manner as in Example 2 except that the ratio of the crystalline polyester B expressed by B/(A+B)×100 was changed to 10 while the total amount of the non-crystalline polyester resin A and the crystalline polyester resin B contained in the toner was maintained. Specifically, in the preparation of oil phase, the amounts of the [pigment•WAX dispersion liquid] and the [solution of a reaction precursor of crystalline polyester resin B-2] were adjusted and the [ketimine compound 1] was added in such an amount that the amount by mol of isophorondiamine eliminated as a result of reaction with water was 1.1 times the amount by mol of the NCO. The properties thereof are presented in Table 1, indicating that it was possible to obtain a high-quality toner excellent in both low-temperature fixing property and blocking resistance.

Comparative Example 1

A toner was produced in the same manner as in Example 2 except that the ratio of the crystalline polyester B expressed by B/(A+B)×100 was changed to 5 while the total amount of the non-crystalline polyester resin A and the crystalline polyester resin B contained in the toner was maintained. Specifically, in the preparation of oil phase, the amounts of the [pigment•WAX dispersion liquid] and the [solution of a reaction precursor of crystalline polyester resin B-2] were adjusted and the [ketimine compound 1] was added in such an amount that the amount by mol of isophorondiamine eliminated as a result of reaction with water was 1.1 times the amount by mol of the NCO. The properties thereof are presented in Table 1, indicating that it was not possible to obtain a toner having sufficient low-temperature fixing property.

Comparative Example 2

A toner was produced in the same manner as in Example 2 except that the ratio of the crystalline polyester B expressed by B/(A+B)×100 was changed to 60 while the total amount of the non-crystalline polyester resin A and the crystalline polyester resin B contained in the toner was maintained. Specifically, in the preparation of oil phase, the amounts of the [pigment•WAX dispersion liquid] and the [solution of a reaction precursor of crystalline polyester resin B-2] were adjusted and the [ketimine compound 1] was added in such an amount that the amount by mol of isophorondiamine eliminated as a result of reaction with water was 1.1 times the amount by mol of the NCO. The properties thereof are presented in Table 1, indicating that it was not possible to obtain a toner having sufficient fixing temperature range and storageability.

Comparative Example 3

A solution of a reaction precursor of crystalline polyester resin B-4 was prepared in the same manner as in "Synthesis of reaction precursor of crystalline polyester resin B" of Synthesis Example 2 except that the molar ratio of HD/CHDM was 60/40. In addition, a toner was produced in the same manner as in Example 2 except that the solution of a reaction precursor of crystalline polyester resin B-2 was changed to the solution of a reaction precursor of crystalline polyester resin B-4. The properties thereof are presented in Table 1, indicating that the obtained toner had sufficient low-temperature fixing property but did not having storageability. Notably, the crystalline polyester resin B-4 obtained in this manner was found to have a melting point of 40° C.

Comparative Example 4

A solution of a reaction precursor of crystalline polyester resin B-5 was prepared in the same manner as in "Synthesis of reaction precursor of crystalline polyester resin B" of Synthesis Example 2 except that the molar ratio of HD/CHDM was 100/0. In addition, a toner was produced in the same manner as in Example 2 except that the solution of a reaction precursor of crystalline polyester resin B-2 was changed to the solution of a reaction precursor of crystalline polyester resin B-5. The properties thereof are presented in Table 1, indicating that it was not possible to obtain a reaction precursor having solubility to an organic solvent nor a toner having low-temperature fixing property and storageability. Notably, the crystalline polyester resin B-5 obtained in this manner was found to have a melting point of 64° C.

(Production of Developer)

A developer was produced in the following manner.

—Production of Carrier—

An organostraight silicone (100 parts) (KR271, product of Shin-Etsu Chemical Co., Ltd.), 5 parts of γ-(2-aminoethyl) aminopropyltrimethoxysilane and 10 parts of carbon black (REGAL330, product of Cabot Co.) were added to 100 parts of toluene, and these materials were dispersed using a homomixer for 20 min, to thereby prepare a resin layer-coating liquid. Subsequently, using a fluidized-bed coater, the resin layer-coating liquid was coated on the surfaces of spherical magnetite particles (1,000 parts) having a volume average particle diameter of 50 μm (CM grade, product of Hoeganaes Co.), whereby a carrier was prepared.

—Production of Developer—

Using a ball mill, 5 parts of each toner and 95 parts of the above-prepared carrier were mixed together to produce developers.

<Evaluation>

Each of the produced toners was evaluated in the below-described methods for TMA % and blocking resistance. In addition, each of the produced developers was evaluated for fixing property.

—TMA %—

Toner base particles (5 mg) were tabletted using a tablet die 3 mm in diameter (product of Shimadzu Corporation) and the obtained tablet was tested using a thermo mechanical analyzer (EXSTAR7000, product of SII NanoTechnology Inc.). The measurement was performed in a compression mode while the tablet was heated from 0° C. to 80° C. at 2° C./min with 90% relative humidity. The compression force in this measurement was set to 100 mN. On a graph between the sample's temperature and its compression displacement (deformation rate), a compression displacement (deformation rate) at 50° C. was read and defined as TMA %.

—Evaluation of Blocking Resistance—

A glass container was filled with each toner and left to stand for 24 hours in a thermostat bath of 50° C. This toner was cooled to 24° C. and its blocking resistance was evaluated based on the extent of blocking (aggregation) according to the following criteria.

A: No blocking occurred.

B: Blocking occurred but the aggregated toner was easily dispersed by application of force; non-problematic in practical use.

C: Blocking occurred and the aggregated toner was not dispersed even by application of force.

—Fixing Temperature—

The fixing portion of a copier (MF2200, product of Ricoh Company, Ltd.) using a TEFLON (registered trademark) roller as a fixing roller was modified and used for copying test of Type 6200 paper (product of Ricoh Company, Ltd.).

Specifically, an offset image was visually confirmed with the fixing temperature changed, to thereby determine a cold offset temperature (the minimum fixing temperature) and a hot offset temperature (the maximum fixing temperature).

The evaluation conditions for the minimum fixing temperature were as follows: the linear velocity of paper feeding: 120 mm/sec to 150 mm/sec, the surface pressure: 1.2 kgf/cm$^2$, and the nip width: 3 mm.

The evaluation conditions for the maximum fixing temperature were as follows: the linear velocity of paper feeding: 50 mm/sec, the surface pressure: 2.0 kgf/cm$^2$, and the nip width: 4.5 mm.

The fixing temperature range was defined as a range between the cold offset temperature (the minimum fixing temperature) and the hot offset temperature (the maximum fixing temperature).

Here, the minimum fixing temperature of 115° C. or lower and the fixing temperature range of 40° C. or more are preferred in practical use in terms of fixing property.

—Solubility of the Reaction Precursor of Crystalline Polyester Resin B to Organic Solvent—

Whether the reaction precursor of crystalline polyester resin B dissolved in ethyl acetate at 25° C. at a concentration of 30% by mass or higher was visually determined according to the following criteria using a 30% ethyl acetate solution of the reaction precursor of crystalline polyester resin B.

A: When left to stand still at 25° C., the solution kept its flowability for 24 hours or longer.

B: The reaction precursor of crystalline polyester resin B did not dissolve.

TABLE 1

| | | Ex. 1 | Ex. 2 | Ex. 3 | Ex. 4 | Ex. 5 | Comp. Ex. 1 | Comp. Ex. 2 | Comp.Ex. 3 | Comp. Ex. 4 |
|---|---|---|---|---|---|---|---|---|---|---|
| Non-crystalline polyester resin A | Acid value | | | 18.5 | | | | | 18.5 | |
| | Mn | | | 2,400 | | | | | 2,400 | |
| | Mw | | | 5,400 | | | | | 5,400 | |
| | Tg/° C. | | | 48.5 | | | | | 48.5 | |
| Reaction precursor of crystalline polyester resin B | Mn | 4,700 | 4,250 | 4,000 | 4,250 | 4,250 | 4,250 | 4,250 | 3,800 | 3,750 |
| | Mw | 11,000 | 12,000 | 11,000 | 12,000 | 12,000 | 12,000 | 12,000 | 12,500 | 11,500 |
| | Tm/° C. | 55 | 51 | 47 | 51 | 51 | 51 | 51 | 40 | 64 |
| | Solubility to an organic solvent | A | A | A | A | A | A | A | A | B |
| Toner | B/(A + B) × 100 | 17.5 | 17.5 | 17.5 | 45 | 10 | 5 | 60 | 17.5 | 17.5 |
| | TMA% | 3.2 | 5.2 | 8.9 | 5.0 | 3.3 | 4.6 | 12.6 | 16.3 | 15.2 |
| | Min. fixing temp./° C. | 100 | 105 | 100 | 90 | 105 | 120 | 95 | 90 | 125 |
| | Fixing temp. range/° C. | 50 | 55 | 45 | 50 | 55 | 55 | 30 | 40 | 40 |
| | Blocking resistance | A | A | B | B | A | A | C | C | C |

Aspects of the present invention are as follows, for example.

<1> An electrostatic image forming toner including:

toner base particles each containing at least a colorant, a binder resin, and a releasing agent, wherein the binder resin contains a non-crystalline polyester resin A and a crystalline polyester resin B, wherein a ratio of B/(A+B)×100 is 10 or more but less than 50 where (A+B) is a total mass of the non-crystalline polyester resin A and the crystalline polyester resin B and "B" is a mass of the crystalline polyester resin B, and wherein the toner base particles have a TMA compression deformation amount (TMA %) of 10% or less which is measured at 50° C. and a relative humidity of 90%.

<2> The electrostatic image forming toner according to <1>, wherein the ratio of B/(A+B)×100 is 15 or more but 20 or less.

<3> The electrostatic image forming toner according to <1> or <2>, wherein the crystalline polyester resin B is a modified crystalline polyester resin having a melting point of 45° C. or higher but lower than 60° C. and containing a urethane bond, a urea bond or both thereof.

<4> The electrostatic image forming toner according to <3>, wherein the melting point of the crystalline polyester resin B is 50° C. or higher but 55° C. or lower.

<5> The electrostatic image forming toner according to any one of <1> to <4>, wherein the crystalline polyester resin B contains a polyesterdiol skeleton formed through copolymerization between a polyhydric alcohol component and a polycarboxylic acid component, and the polyhydric alcohol component contains 1,4-cyclohexanedimethanol in an amount of 5 mol % to 30 mol %.

<6> The electrostatic image forming toner according to <5>, wherein the polyhydric alcohol component contains 1,4-cyclohexanedimethanol in an amount of 10 mol % to 20 mol %.

<7> The electrostatic image forming toner according to any one of <1> to <6>, wherein the electrostatic image forming toner is granulated by dispersing, in an aqueous medium, an oil phase containing at least the non-crystalline polyester resin A, the releasing agent, the colorant and the crystalline polyester resin B, a reaction precursor of the crystalline polyester resin B or both of the crystalline polyester resin B and the reaction precursor of the crystalline polyester resin B.

<8> The electrostatic image forming toner according to <7>, wherein the granulation of the electrostatic image forming toner in the aqueous medium is performed by: dispersing, in the aqueous medium, the oil phase prepared by dissolving or dispersing in an organic solvent at least the non-crystalline polyester resin A, the reaction precursor of the crystalline polyester resin B, the releasing agent and the colorant, to thereby prepare a dispersion liquid; allowing the reaction precursor of the crystalline polyester resin B to undergo crosslinking or elongating reaction with a curing agent in the dispersion liquid; and removing the organic solvent from the dispersion liquid.

<9> The electrostatic image forming toner according to <8>, wherein the reaction precursor of the crystalline polyester B is soluble to an organic solvent.

<10> A developer including:

the electrostatic image forming toner according to any one of <1> to <9>.

This application claims priority to Japanese application No. 2012-017707, filed on Jan. 31, 2012, and incorporated herein by reference.

What is claimed is:

1. An electrostatic image forming toner comprising:

toner base particles each containing at least a colorant, a binder resin, and a releasing agent, wherein the binder resin contains a non-crystalline polyester resin A and a crystalline polyester resin B, wherein non-crystalline polyester resin A is produced by copolymerizing a polyhydric alcohol component and a polycarboxylic acid component, wherein the crystalline polyester resin B is a modified crystalline polyester resin having a melting point of 45° C. or higher but lower than 60° C. and containing a urethane bond, a urea bond or both thereof, wherein a ratio of B/(A+B)×100 is 10 or more but less than 50 where (A+B) is a total mass of the non-crystalline polyester resin A and the crystalline polyester resin B and "B" is a mass of the crystalline polyester resin B, and wherein the toner base particles have a TMA compression deformation amount (TMA %) of 10% or less which is measured at 50° C. and a relative humidity of 90%.

2. The electrostatic image forming toner according to claim 1, wherein the ratio of B/(A+B)×100 is 15 or more but 20 or less.

3. The electrostatic image forming toner according to claim 1, wherein the melting point of the crystalline polyester resin B is 50° C. or higher but 55° C. or lower.

4. The electrostatic image forming toner according to claim 1, wherein the crystalline polyester resin B contains a polyesterdiol skeleton formed through copolymerization between a polyhydric alcohol component and a polycarboxylic acid component, and the polyhydric alcohol component contains 1,4-cyclohexanedimethanol in an amount of 5 mol % to 30 mol %.

5. The electrostatic image forming toner according to claim 4, wherein the polyhydric alcohol component contains 1,4-cyclohexanedimethanol in an amount of 10 mol % to 20 mol %.

6. The electrostatic image forming toner according to claim 1, wherein the electrostatic image forming toner is granulated by dispersing, in an aqueous medium, an oil phase containing at least the non-crystalline polyester resin A, the releasing agent, the colorant and the crystalline polyester resin B, a reaction precursor of the crystalline polyester resin B or both of the crystalline polyester resin B and the reaction precursor of the crystalline polyester resin B.

7. The electrostatic image forming toner according to claim 6, wherein the granulation of the electrostatic image forming toner in the aqueous medium is performed by: dispersing, in the aqueous medium, the oil phase prepared by dissolving or dispersing in an organic solvent at least the non-crystalline polyester resin A, the reaction precursor of the crystalline polyester resin B, the releasing agent and the colorant, to thereby prepare a dispersion liquid; allowing the reaction precursor of the crystalline polyester resin B to undergo crosslinking or elongating reaction with a curing agent in the dispersion liquid; and removing the organic solvent from the dispersion liquid.

8. The electrostatic image forming toner according to claim 7, wherein the reaction precursor of the crystalline polyester B is soluble to an organic solvent.

9. A developer comprising:

an electrostatic image forming toner wherein the electrostatic image forming toner comprises: toner base particles each containing at least a colorant, a binder resin, and a releasing agent, wherein the binder resin contains a non-crystalline polyester resin A and a crystalline polyester resin B, wherein non-crystalline polyester resin A is produced by copolymerizing a polyhydric alcohol component and a polycarboxylic acid component, wherein the crystalline polyester resin B is a modified crystalline polyester resin having a melting point of 45° C. or higher but lower than 60° C. and containing a urethane bond, a urea bond or both thereof, wherein a ratio of B/(A+B)×100 is 10 or more but less than 50 where (A+B) is a total mass of the non-crystalline polyester resin A and the crystalline polyester resin B and "B" is a mass of the crystalline polyester resin B, and wherein the toner base particles have a TMA compression deformation amount (TMA %) of 10% or less which is measured at 50° C. and a relative humidity of 90%.

* * * * *